US006598572B2

(12) United States Patent
Cecur et al.

(10) Patent No.: US 6,598,572 B2
(45) Date of Patent: Jul. 29, 2003

(54) HYDRAULIC LASH ADJUSTER

(75) Inventors: Majo Cecur, Marshall, MI (US); Umberto Nicoli, Montignoso (IT)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/166,191

(22) Filed: Jun. 10, 2002

(65) Prior Publication Data

US 2003/0015158 A1 Jan. 23, 2003

(30) Foreign Application Priority Data

Jun. 15, 2001 (EP) ..... 01830399

(51) Int. Cl.[7] ..... F01L 1/14

(52) U.S. Cl. ..... 123/90.55; 123/90.52; 123/90.48; 123/90.46

(58) Field of Search ..... 123/90.55, 90.43, 123/90.45, 90.46, 90.48, 90.52–90.57

(56) References Cited

U.S. PATENT DOCUMENTS

| | | | | |
|---|---|---|---|---|
| 4,763,617 A | * | 8/1988 | Honda et al. | 123/90.58 |
| 5,622,147 A | * | 4/1997 | Edelmayer | 123/90.35 |
| 6,170,450 B1 | * | 1/2001 | Cecur | 123/90.55 |

* cited by examiner

*Primary Examiner*—Thomas Denion
*Assistant Examiner*—Kyle Riddle
(74) *Attorney, Agent, or Firm*—L. J. Kasper

(57) ABSTRACT

A hydraulic lash adjuster has a plunger assembly the outer end of which can be moved inwardly until the inner end abuts a seal and closes a high pressure chamber, thus preventing further movement. This accommodates any necessary movement of a valve towards its closing position to ensure proper closure. Consequently, net-shaped cams wherein the base circle is not necessarily accurately concentric may be used. A leaf spring ensures opening of the chamber when the base circle of the cam is next reached.

13 Claims, 5 Drawing Sheets

HYDRAULIC LASH ADJUSTER

BACKGROUND OF THE DISCLOSURE

This invention relates to hydraulic lash adjusters for taking up slack in a valve train, and to valve train assemblies which incorporate hydraulic lash adjusters.

A typical structure of this type is shown schematically in FIG. 1. The valve train assembly 2 comprises a rocker arm 4 and a hydraulic lash adjuster 6. One end 8 of the rocker arm 4 engages the stem 10 of a valve 11. The other end 12 of the rocker arm is mounted for pivotal movement on the lash adjuster 6.

The rocker arm 4 is provided with a roller 14 mounted on an axle 16 carried by the rocker arm 4.

A cam 18 mounted on a cam shaft 15 has a lobe 17 which can engage the roller 14 and thus pivot the rocker arm 4 anti-clockwise as shown in the drawing. This depresses the valve stem 10 against the force of a valve spring (not shown) and thus opens the valve. As the cam continues to rotate, and the base circle 19 of the cam profile again engages the roller 14, the valve spring returns the valve and the rocker arm 4 to the position shown in FIG. 1.

As is well known, a hydraulic lash adjuster has an oil-containing chamber and a spring arranged to enlarge the chamber and thus extend the lash adjuster. Oil flows into the chamber via a one-way valve, but can escape the chamber only slowly, for example via closely-spaced leakdown surfaces.

Accordingly, the lash adjuster 6 of FIG. 1 can extend to accommodate any slack in the valve train assembly, such as between the cam 18 and the roller 14. After it is extended, however, the oil-filled chamber provides sufficient support for the pivoting movement of the rocker arm 4.

It is important for the base circle 19 of the cam 18 to be concentric with respect to the axis of rotation of the cam shaft 15. Any slight eccentricity ("run-out") could cause the valve to close later than it should, or open during the movement of the base circle past the roller 14. The cam 18 is often formed by sintering and may not have, in its initial state, particularly accurate dimensions. Accordingly, it is conventional, before assembly, to grind either the outer surface, including the base circle 19, of the cam 18, or to grind the inner diameter which is fitted to the cam shaft 15, to ensure accurate concentricity of the base circle 19 relative to the axis of rotation of the cam shaft 15.

Although the arrangement described above works well during normal running conditions, problems can arise in certain circumstances. For example, in order to prevent problems when starting the engine from cold, it has been proposed to use a technique whereby the valves and cylinder head are caused to heat up very quickly. Referring to FIG. 2, the rapid heating of the head 20 of the valve 11 causes the head 20 to expand relative to the valve seat 21. This expansion results in the valve moving downwardly against the force of the valve spring, as shown on the right of FIG. 2. This process creates positive lash, which is accommodated by expansion of the hydraulic adjuster as the camshaft rotates. However, as the cylinder head 22 and the valve seat 21 then heat up, their expansion allows the valve 11 to move back upwardly, thus creating negative lash (which will be subsequently exacerbated due to expansion of the valve stem). This negative lash can be accommodated by shrinking of the lash adjuster. However, because the heating process is taking place rapidly, and the shortening of the lash adjuster is limited by the rate of leakage of oil from the high pressure chamber, the lash adjuster does not shorten sufficiently quickly. This problem is exacerbated because the oil is still cold and therefore viscous, thus reducing the leakage rate. This results in valves remaining open (shown in dotted lines in FIG. 1), causing starting problems.

There have been proposed lash adjusters which provide "lift loss", that is, which are capable of shrinking to a certain extent before the sealed high-pressure chamber prevents further movement. See for example U.S. Pat. No. 6,039,017. Thus, there is a degree of lost motion of the lash adjuster before the valve starts to open. This lost motion is recovered by a spring after the valve has closed. Using such a lash adjuster, a small degree of negative lash can be quickly accommodated by the lost motion of the lash adjuster, thus making it more certain that the valve will close.

There are also lash adjusters which incorporate a seal to prevent leakage of oil from the high-pressure chamber, and in which the chamber valve is arranged such that it is normally open (known as "sealed-leakdown" adjusters). See U.S. Pat. No. 5,622,147. This would permit a small amount of shortening of the lash adjuster before the valve closes as a result of the hydrodynamic force of the oil flowing out of the chamber. However, the amount of lift loss produced is somewhat uncertain, and will depend significantly on oil viscosity and hence temperature, as well as other factors. Also, this form of lash adjuster can sometimes encounter problems when a hot engine is stopped with a valve partially open. The pressure of the valve spring on the lash adjuster causes the high-pressure chamber to remain sealed, so that, if the engine cools and negative lash is created, oil cannot flow out of the chamber and the lash is therefore not accommodated.

It would be desirable to provide a lash adjuster of the sealed-leakdown type in which such problems are at least mitigated.

BRIEF SUMMARY OF THE INVENTION

Aspects of the present invention are set out in the accompanying claims.

In a first aspect of the invention, the high-pressure chamber is sealed by a sealing means engaging both the body of the lash adjuster and the plunger as the plunger moves inwardly, thus preventing further inward movement. The arrangement is such that as the cam turns, and returns to base circle, and the pressure on the plunger decreases, the plunger and sealing means separate, preferably assisted by a biasing means such as a leaf spring. Accordingly, the pressure in the chamber is relieved whenever the base circle of the cam is reached. Because the chamber is open, the plunger assembly can be pushed inwardly by a certain amount to guarantee valve closure before the chamber is again closed.

According to a preferred aspect of the invention, it has been perceived that use of a hydraulic lash adjuster which provides lift loss (preferably, but not necessarily, an adjuster according to the first aspect of the invention) means that the base circle radius variation of the cam no longer has to be minimized by grinding, allowing the use of net-shaped cam shaft technology instead of more expensive ground cams.

DETAILED DESCRIPTION OF THE PREFERRED EMBODIMENT

Figure 3:
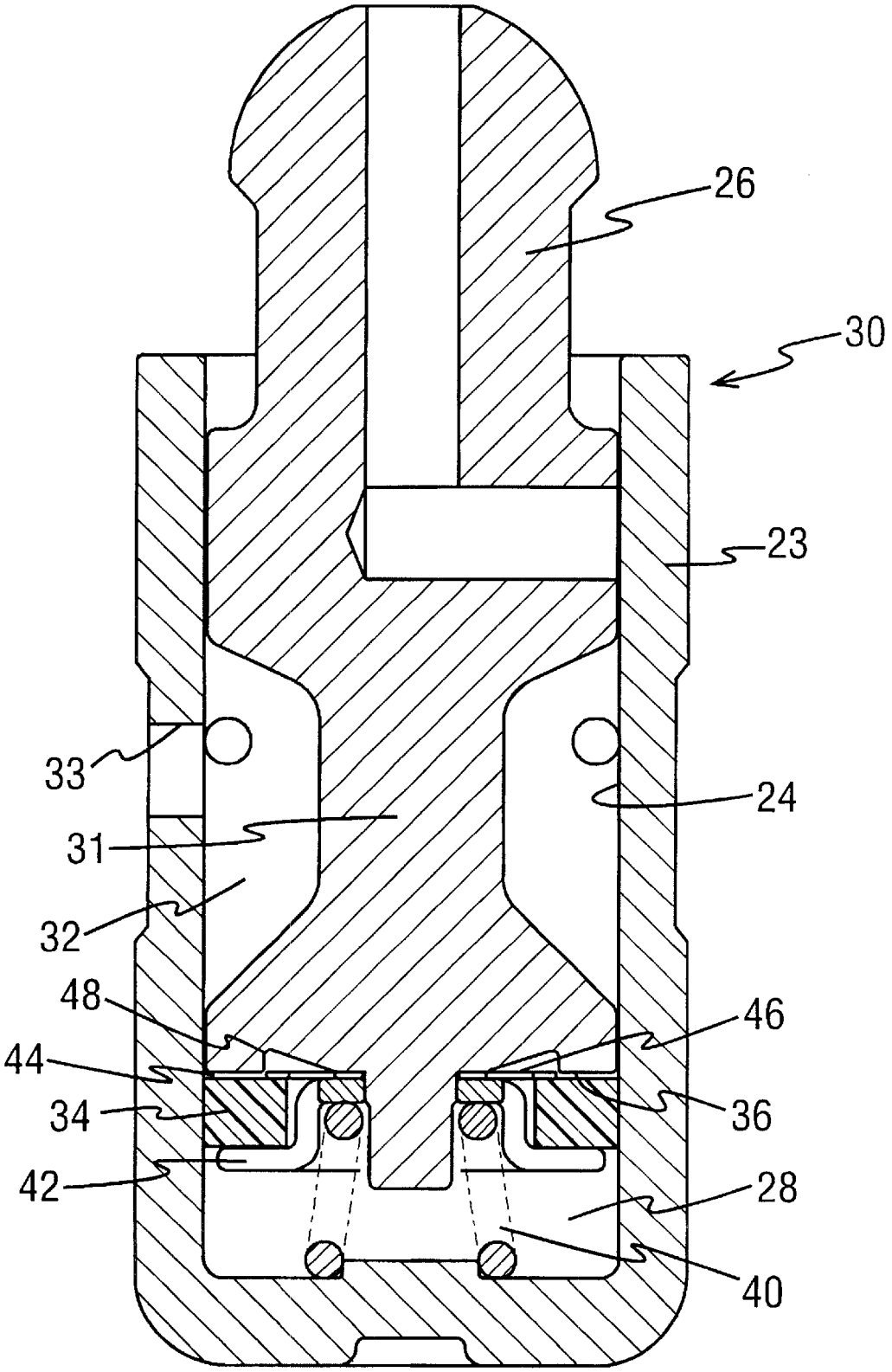
FIG. 3 is a longitudinal cross section through a hydraulic lash adjuster according to a first embodiment of the invention.

Referring to FIG. 3, this shows a lash adjuster 30 according to a first embodiment of the invention. The lash adjuster has a cylindrical body 23 formed with a longitudinal blind bore 24. A plunger assembly 26, which in this embodiment is a one-piece assembly but could alternatively be formed of two or more parts, is mounted for sliding motion inwardly and outwardly of the bore 24. The plunger assembly 26 and blind bore 24 define between them a high-pressure oil chamber 28 at the lower end of the lash adjuster 30.

The plunger assembly 26 is formed with a relatively narrow waist 31 so that a low-pressure oil chamber 32 is formed between this waist and the bore 24. Oil from the associated engine can enter the chamber 32 via an aperture 33.

Figure 4:
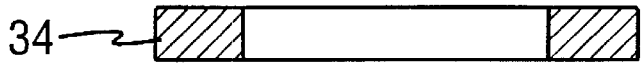
FIGS. 4 to 7 show respective components of the hydraulic lash adjuster of FIG. 3.

The lash adjuster 30 is provided with an annular polytetrafluoroethylene (PTFE) seal 34 (also shown in cross-section in FIG. 4). The cylindrical outer surface of the seal 34 is an interference fit in, and sealingly engages, the bore 24. The upper surface of the seal 34 can sealingly engage a circumferential outer sealing surface 36 on the bottom of the plunger assembly 26.

Figure 5:
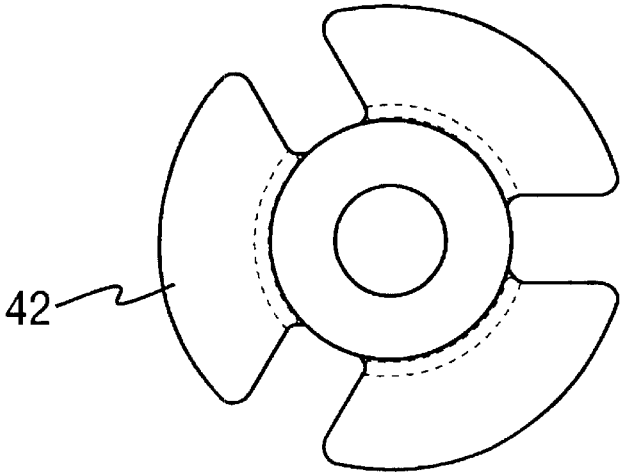
Figure 6:
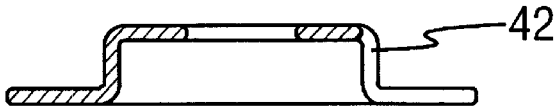

A spring 40 engages the upper, central part of a cap-shaped retainer 42 (shown in plan view in FIG. 5 and side view in FIG. 6), and forces the retainer 42 into engagement with the plunger assembly 26, the retainer 42 engaging the center of the base of the assembly 26. The upper part of the retainer is located within the annular seal 34 and the circumferential outer part is located under the annular seal.

The spring 40 pushes the seal 34 and the plunger assembly 26 outwardly of the bore 24. In this state, oil can flow from the low pressure chamber 32 around the side of the plunger assembly, through a gap 44 between the sealing surface 36 and the seal 34 and into the high pressure chamber 28. The outer diameter of the lower part of the plunger assembly 26 is sufficiently smaller than the diameter of the bore 24 to allow oil readily to flow therebetween. Accordingly, the plunger assembly can move outwardly to take up slack in the valve train. Any significant outward movement of the plunger assembly will also result in the seal 34 being shifted in the same direction by the outer part of the retainer 42.

Figure 7:
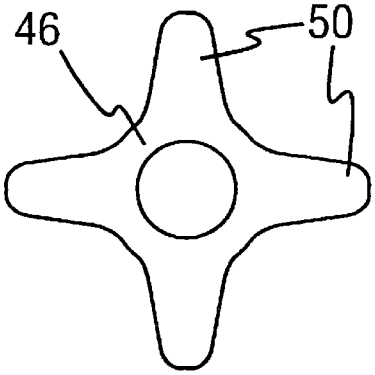

The lash adjuster 30 is also provided with a leaf spring 46, shown in plan view in FIG. 7, disposed between the lower end of the plunger assembly 26 and the upper surface of the retainer 42. See also the enlarged views of FIGS. 8 and 9. The lower surface of the plunger assembly 26 is provided with a circular recess 48, which is deeper at the radially outer part thereof. The leaf spring 46 has four arms 50 which are located under the recess 48, and the outer ends of which are located over the PTFE seal 34.

Figure 8:
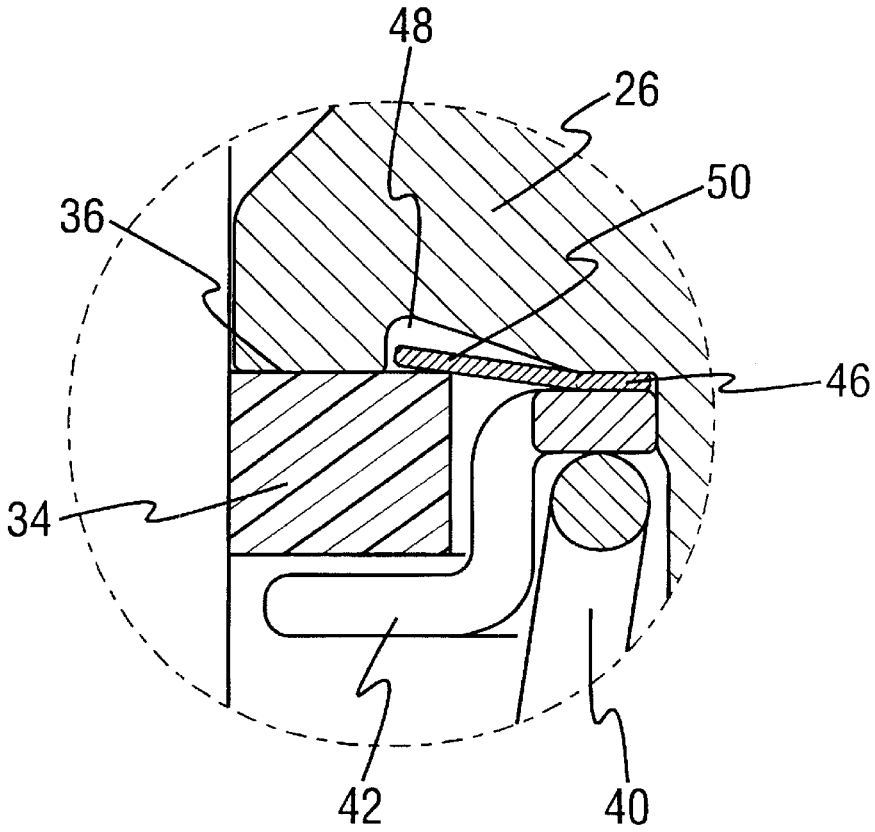
FIGS. 8 and 9 are enlarged views of part of the hydraulic lash adjuster of FIG. 3 illustrating different states encountered during operation of the lash adjuster.
Figure 9:
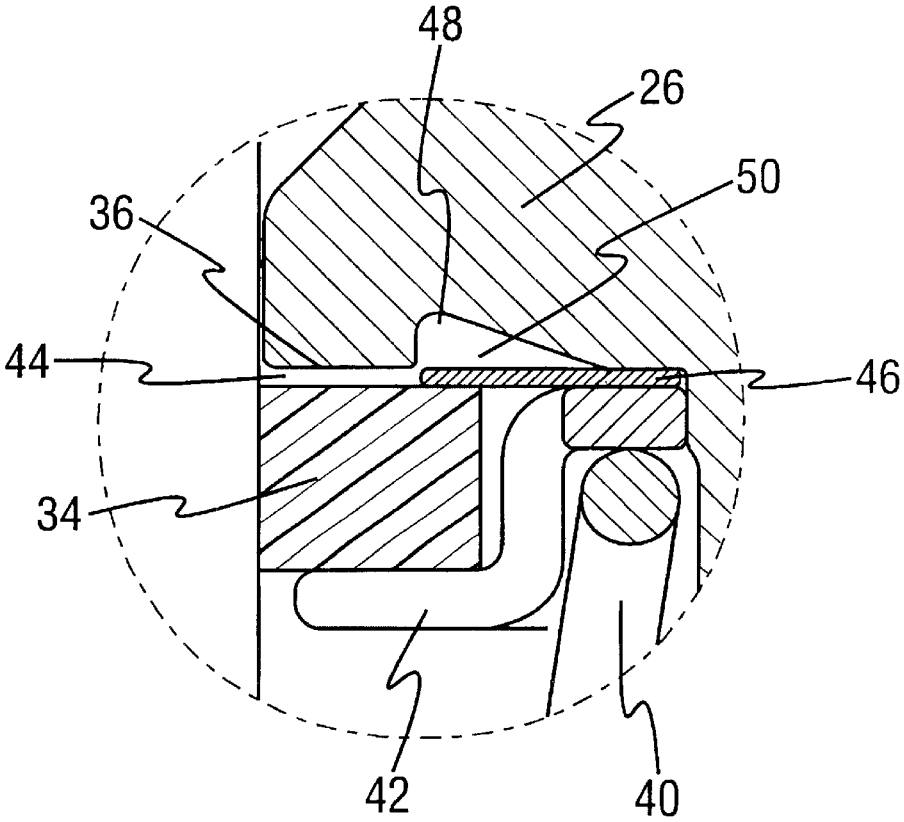

FIG. 8 shows the state of the lash adjuster when the lobe of the cam is applying force to open the valve. The plunger assembly 26 is depressed, engaging the PTFE seal 34 so that the high pressure chamber 28 is closed and further inward movement of the plunger assembly 26 is thus prevented. In this state, the arms 50 of the leaf spring 46 are deflected upwardly by their engagement with the PTFE seal 34.

When the base circle of the cam is approached, the plunger assembly 26 is allowed to move outwardly under the force of the spring 40. This of course can occur only if oil is allowed to flow into the chamber via the gap 44 (FIG. 9) which is at that stage created between the sealing surface 36 of the plunger assembly 26 and the seal 34. Various forces combine to ensure this movement occurs, including the resilience of the arms 50 of the leaf spring 46, the force of the spring 40 and the force holding the seal 34 against the wall of the bore 24 (which may be a combination of friction and stickiness caused by migration of PTFE into the wall). Such forces have to be sufficient to overcome the pressure holding the seal 34 against the sealing surface 36, and then any hydrodynamic forces of the oil escaping the chamber 28, which would tend to move the seal 34 upwardly. The spring 46 is particularly desirable in this connection, as it tends to peel apart the seal 34 and the sealing surface 36. However, the exact force exerted by the leaf spring 46 is not critical.

Accordingly, during operation, it is ensured that the high pressure in the chamber 28 is relieved after the valve has closed, thereby creating lift loss so that the plunger assembly 26 can move inwardly before the valve starts to open, and outwardly after the valve has closed. If the lash adjuster needs to shrink rapidly in order to accommodate the closing motion of the valve, this is accommodated by virtue of the pressure on the plunger assembly 26 causing the assembly to move to a position intermediate the states shown in FIGS. 8 and 9, thus guaranteeing closure of the valve. If negative lash persists, the seal 34 will be gradually pushed down by the plunger 26 and the spring 46, thereby eventually restoring the intended maximum amount of lift loss.

Figure 1:
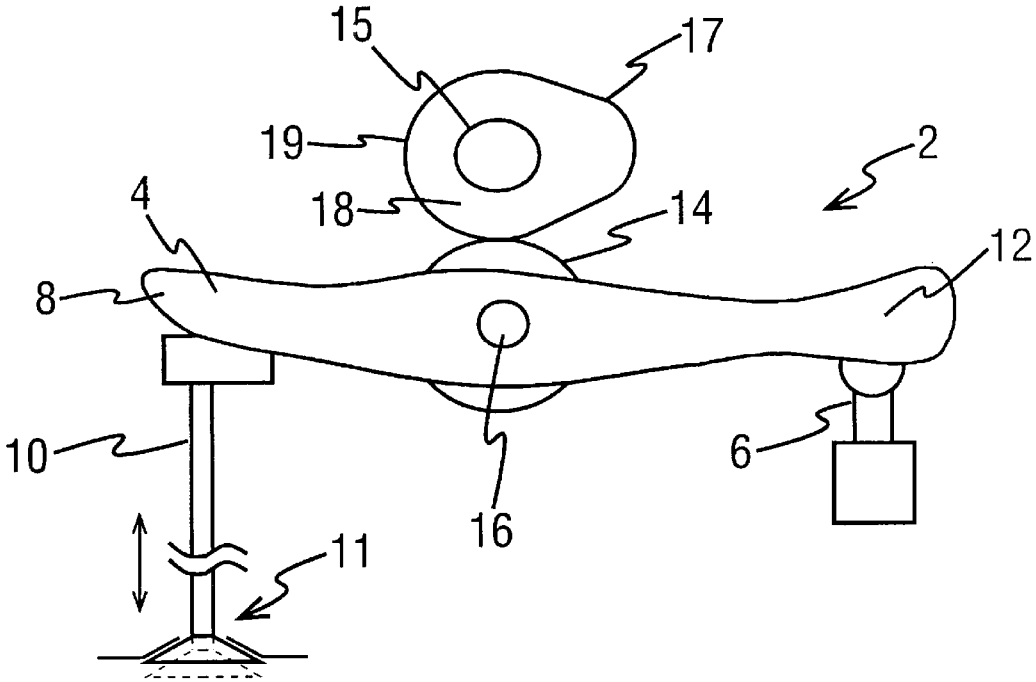
FIG. 1 (PRIOR ART)
FIG. 1 schematically shows a conventional valve train assembly.
Figure 2:
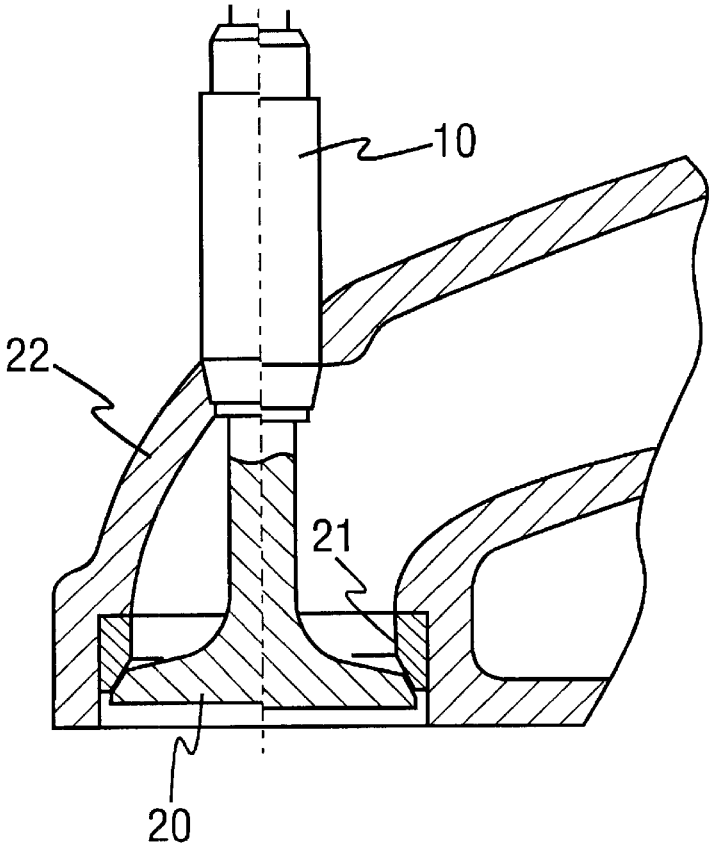
FIG. 2 (PRIOR ART)
FIG. 2 illustrates differential expansion of engine components in an engine of known type.

The lash adjuster of FIG. 3 is intended to be used with a rocker arm such as that shown at 4 in FIG. 1. The lash adjuster could form the pivot of the arm, and the cam could operate on the rocker arm at a location between the lash adjuster and the valve stem (as in FIG. 1), or various other configurations (known in themselves) could be used, for example having the lash adjuster disposed between the rocker arm and either the valve stem or the cam.

Figure 10:
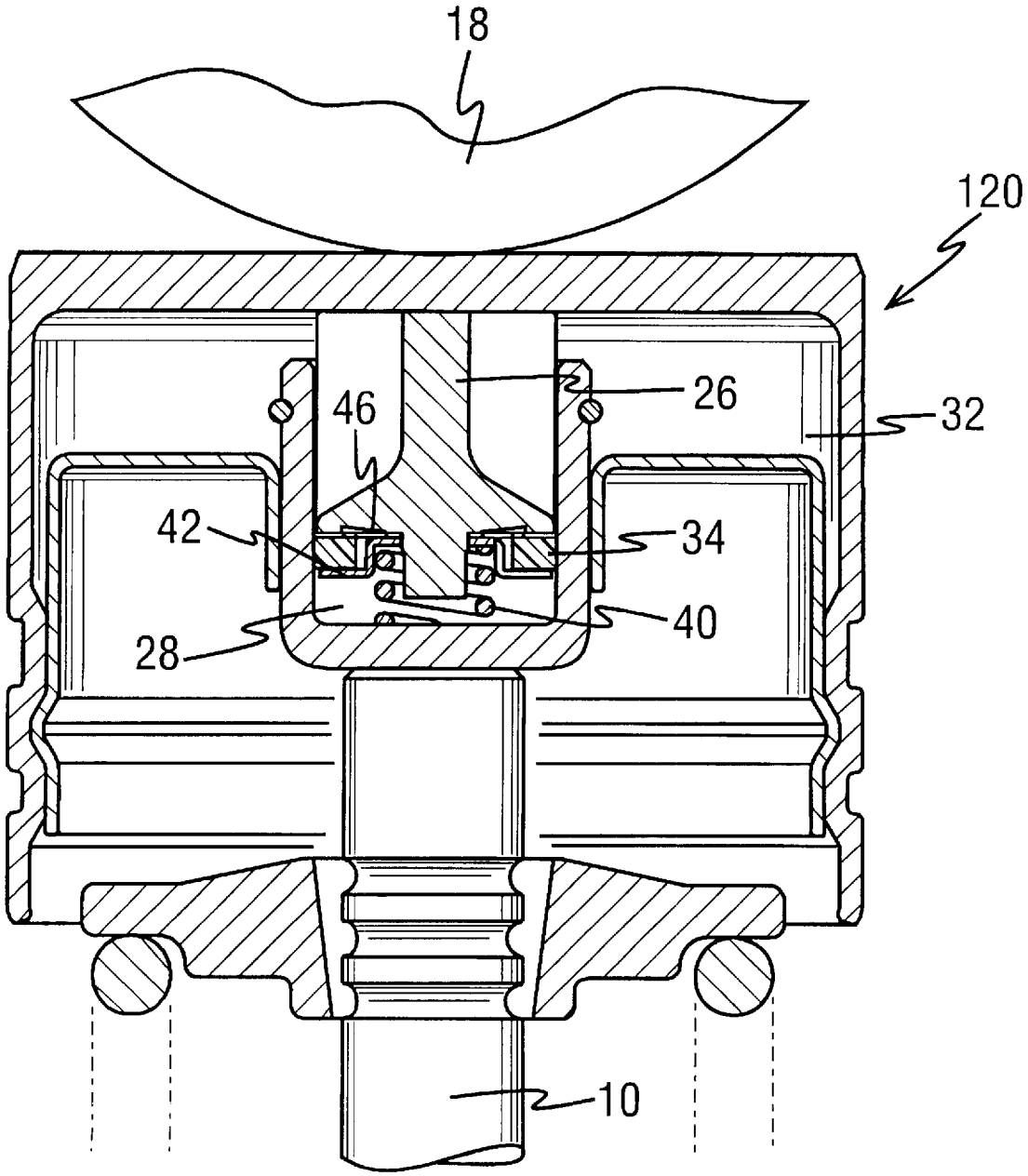
FIG. 10 is a longitudinal section through a hydraulic lash adjuster according to a second embodiment of the invention.

FIG. 10 shows a second embodiment, in the form of a direct-acting bucket tappet 120 incorporating a hydraulic lash adjuster 30 and arranged to move a valve stem 10 in response to the rotation of a cam 18. This embodiment has components corresponding to those of the FIG. 3 arrangement, with like components bearing like reference numerals, and operates in the same way. The arrangement differs from the FIG. 3 arrangement only insofar as the components are configured in a per se known way for use with a bucket tappet which has the low-pressure reservoir 32.

The cams 18 used to operate the valves of the above arrangements have been formed by a sintering operation (but could alternatively have been formed by other means, such as hydroforming or hot- or cold-forming). However, no additional grinding operations have been performed on either the outer surface of the base circles or the inner surfaces of the cams. Accordingly, the base circle of each cam is not necessarily accurately concentric with respect to the axis of rotation. The cam 18 is thus net-shaped. However, because of the use of the hydraulic lash adjusters described above, the base circle radius variations of the cam no longer have to be minimized by grinding, because any non-concentricity of the base circle will be accommodated by inward movement of the outer end of the plunger assembly 26, thus avoiding incorrect valve opening. (The term net-shaped is generally understood, and used herein, in the sense of having a shape and dimensions which are at least substantially the same as those resulting from the initial forming of the object. This does not exclude the possibility of small changes in dimensions which are a consequence of, for example, surface-treatment for the purpose of smoothing, as distinct from dimensional changes (e.g. by grinding) for the purpose of altering the function performed as a result of those dimensions.)

Although significant grinding is avoided, it may be desirable for the outer surface of the cam to be treated for the purpose of smoothing the exterior of the cam. This may be of particular value in the embodiment of FIG. 10 when the cam operates on a direct-acting bucket tappet, rather than on a roller.

In all the arrangements described above, because movement of the outer end of the plunger is allowed, the valve opens later and closes sooner, in relation to the rotation of the cam, than in prior art arrangements. In order to compensate, the profile of the cam is altered as compared with prior art arrangements. A further alteration to the profile may be made in order to extend the ramp of the cam lobe to ensure that the movement of the outer end of the plunger assembly 26 takes place at a controlled velocity to reduce impact forces.

In the above embodiments, the gap 44 defines the maximum amount of lift loss. This in turn is specified by the dimensions of the seal 34 and the retainer 42. The leaf spring 46 preferably has a thickness substantially equal to the thus-defined gap size (although if the spring is slightly thicker, this simply means it will remain in a partially-flexed condition). The gap, and hence the amount of lift loss, should: (a) equal or exceed the maximum amount of negative lash created by the differential thermal expansion of the various engine components, plus, if a net-shaped cam is used, the lash created by the maximum expected amount of run-out of the base circle, i.e. the maximum amount by which the base circle radius varies; and (b) be less than the amount which would cause excessive valve closure speeds. (It will be appreciated that provision of lift loss means that valve opening and closing will take place over a smaller arc of cam rotation, and thus at increased speed.)

In one preferred embodiment the size of the gap 44 is in the range of 0.1 mm to 0.3 mm, and more preferably in the range 0.15 mm to 0.25 mm.

The spring 40 of the embodiments described above biases both the plunger assembly 26 and the seal 34 outwardly, although it does not bias these components towards each other and so does not inhibit opening of the chamber. It would alternatively be possible to have separate biasing means for the plunger assembly 26 and the seal 34; in this case, preferably, the biasing means for the seal is limited in the extent to which it can move the seal towards the plunger (e.g. by inter-engagement of the separate biasing means and the plunger, or suitable selection of the strength of this biasing means with respect to that of the leaf spring 46) so that it does not inhibit the restoration of the gap 44.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A hydraulic lash adjuster for an internal combustion engine, the lash adjuster comprising a body, a plunger assembly slidably received within a bore in the body and co-operating with the body to define a fluid pressure chamber, and biasing means for urging the plunger assembly in an outward direction with respect to the bore, thus enlarging the pressure chamber, to take up slack in a valve drive train, the adjuster further comprising sealing means which is sealingly engaged with the body and which is brought into sealing engagement with the plunger assembly in response to movement of the plunger assembly in an inward direction with respect to the bore for restricting fluid flow from the pressure chamber so as to inhibit further movement of the plunger assembly in said inward direction, the adjuster being arranged such that the plunger assembly is disengaged from said sealing means and the pressure in said pressure chamber is relieved upon movement of the plunger assembly in said outward direction, so that a limited amount of inward movement can take place each time pressure is applied to the plunger assembly before the chamber is again closed.

2. An adjuster as claimed in claim 1, including second biasing means arranged to bias the sealing means and the plunger away from each other.

3. A hydraulic lash adjuster for an internal combustion engine, the lash adjuster comprising a body, a plunger slidably received within a bore in the body, and sealing means provided in said bore in sealing engagement with the body and sealingly engageable with a sealing surface of the plunger to close a fluid pressure chamber defined by the plunger and the body to prevent inward movement of the plunger, the lash adjuster further comprising biasing means for urging the plunger and sealing means in an outward direction with respect to the bore, thus enlarging the pressure chamber, to take up slack in a valve drive train, the adjuster being arranged such that the sealing surface of the plunger is disengaged from said sealing means and the pressure in said pressure chamber is relieved upon movement of the plunger in said outward direction, so that a limited amount of inward movement can take place each time pressure is applied to the plunger before the chamber is again closed.

4. An adjuster as claimed in claim 3, including second biasing means arranged to bias the sealing means and the plunger away from each other.

5. An adjuster as claimed in claim 4, wherein the second biasing means is a leaf spring.

6. An adjuster as claimed in claim 4, wherein the second biasing means is mounted for movement with the plunger.

7. An adjuster as claimed in claim 3, including retaining means movable with the plunger for supporting the sealing means for limited movement with respect to the plunger, thereby to permit opening and closing of the chamber.

8. An adjuster as claimed in claim 7, including second biasing means also supported by said retaining means and arranged to bias the sealing means and the sealing surface of the plunger away from each other.

9. A valve train assembly as claimed in claim 3, for operating a valve, the assembly comprising a cam arranged to cause the valve to open and close, and a hydraulic lash adjuster for taking up slack in the train between the cam and the valve.

10. An assembly as claimed in claim 9, wherein the cam is a non-ground cam.

11. An assembly as claimed in claim 10, wherein the cam is net-shaped.

12. An assembly as claimed in claim 9, the assembly including a rocker arm arranged to be pivoted by the cam in order to operate the valve.

13. An assembly as claimed in claim 9, wherein the lash adjuster is a direct-acting bucket tappet.

* * * * *